United States Patent [19]

Robinson et al.

[11] Patent Number: 5,006,076

[45] Date of Patent: Apr. 9, 1991

[54] BLADED METER SOCKET COVER

[75] Inventors: Darrell Robinson, Highland, Mich.; John T. Shincovich, North Canton, Ohio

[73] Assignee: Ekstrom Industries, Inc., Farmington Hills, Mich.

[21] Appl. No.: 572,473

[22] Filed: Aug. 23, 1990

[51] Int. Cl.[5] ..... H01R 13/44; H01R 31/08

[52] U.S. Cl. ..... 439/146; 439/148; 439/508

[58] Field of Search ..... 439/146, 148, 508, 517

[56] References Cited

U.S. PATENT DOCUMENTS

| | | | |
|---|---|---|---|
| 2,643,362 | 6/1953 | Johansson | 339/36 |
| 3,519,976 | 7/1970 | Orr | 439/146 |
| 3,528,049 | 9/1970 | Orr | 439/146 |
| 3,614,708 | 10/1971 | Koepfgen | 439/146 |
| 3,683,102 | 8/1972 | Moran et al. | 174/50 |
| 3,806,857 | 4/1974 | Hubeny | 339/19 |
| 3,904,935 | 9/1975 | Brewer et al. | 317/107 |
| 3,943,441 | 3/1976 | Shackford | 324/110 |
| 4,323,294 | 4/1982 | Robinson | 339/19 |
| 4,505,530 | 3/1985 | Fennel | 439/148 |

FOREIGN PATENT DOCUMENTS

| | | |
|---|---|---|
| 729314 | 3/1966 | Canada . |
| 935829 | 9/1963 | United Kingdom . |
| 1421033 | 1/1976 | United Kingdom . |

*Primary Examiner*—Paula A. Bradley

*Attorney, Agent, or Firm*—Basile and Hanlon

[57] ABSTRACT

A cover for an electric meter socket has a planar base and a plurality of blades extending from one surface of the base for releasable engagement with the jaw terminals in the meter socket. Ribs are connected between the base and the blades to support the blades from sideways movement. One rib on at least one and, preferably, all of the blades has an extendable height so as to contact a jaw terminal in the meter socket when the cover is mounted in the meter socket to prevent deflection and movement of the cover with respect to the meter socket.

20 Claims, 2 Drawing Sheets

BLADED METER SOCKET COVER

BACKGROUND OF THE INVENTION

1. Field of the Invention:

This invention relates, in general, to watt hour meter and watt hour meter sockets and, more specifically, to covers for closing the opening in a meter socket when the watt hour meter is removed from the socket.

2. State of the Art:

Covers or closing plates are employed by electric utility companies to close the opening in a meter socket housing when a watt hour meter is not mounted in the socket. Such covers prevent individuals from coming into contact with the live terminals in the meter socket as well as to prevent unauthorized connection to the socket terminals to obtain undeterred electric power.

Covers or closing plates are conventionally formed of a non-conductive material and have a plurality of blades extending from one side which are removably engageable with the jaw terminals in the meter socket to mount the cover in the meter socket. Such covers or closing plates were formed of glass which has sufficient rigidity to resist deflection at the peripheral edges of the cover but is subject to breakage when struck by an object. The use of stronger plastics, such as polycarbonate, to form such covers eliminates the breakage problem, but results in the covers being deflectable to a small amount, particularly at the peripheral edge of the cover.

Ribs have been mounted on such covers between the base of the cover and opposed sides of each blade to support the blades and prevent sideways movement of the blades with respect to the cover. However, such ribs are short in height so as to be spaced from the jaw terminals in the meter socket when the cover is mounted in the meter socket.

Additional ribs have been mounted on such covers extending inward a short distance from the peripheral edge of the covers and oriented parallel and/or perpendicular to the width of the blades (i.e., along the plane of the blades in the direction of insertion of the blades into the jaw terminals in the meter socket). While such additional ribs increase the deflection resistance of such covers, the covers can still be urged inward a small amount thereby allowing access to the interior of the meter socket. Such movement or deflection is greatest at the top and bottom peripheral edges of the cover parallel to the width of the blades when the cover is mounted in a meter socket. Such edges can be moved inward a sufficient amount to enable wires to be inserted past the cover into the meter socket.

Thus, it would be desirable to provide a cover for a meter socket which overcomes such problems existing with previously devised meter socket covers. It would also be desirable to provide a cover for a meter socket which is designed to inhibit inward movement or deflection of the cover with respect to the meter socket when the cover is mounted in the meter socket. Finally, it would be desirable to provide a cover for a meter socket having the above-described features which is inexpensively constructed.

SUMMARY OF THE INVENTION

The present invention is a cover for an electric meter socket having a plurality of jaw terminals and a cover plate having an aperture formed therein for normally receiving a watt hour meter therethrough. The cover has a planar base with first and second opposed major surfaces. A plurality of blades are mounted on and extend outward from the first major surface of the base for releasable engagement in the jaw terminals of the meter socket to mount the cover in the meter socket.

Rib means are mounted on and extend between the base and each of the blades for supporting the blades and for preventing movement of the blades relative to the base of the cover. The rib means associated with at least one blade has a predetermined height such that an exterior edge of the rib means contacts one of the jaw terminals in the meter socket when the cover is mounted on the meter socket to prevent inward movement or deflection of the cover with respect to the meter socket.

In a preferred embodiment, pairs of ribs, each formed of at least first and second ribs, are associated with and connected to each of the blades on the cover. One of the ribs of each pair of ribs has a height so as to be spaced from the jaw terminals when the cover is mounted in the meter socket. The second rib of certain of the pairs of ribs has an elongated height with respect to the other rib in each rib pair so as to contact the jaw terminal when the cover is mounted in the meter socket. Preferably, the first and second ribs in each pair of ribs are arranged co-planar on opposite sides of each blade on the cover. Alternately, the second rib having the elongated height may be disposed on the radially outermost side of a blade with respect to the center of the cover.

The bladed meter socket cover of the present invention overcomes the deficiencies of previously devised meter socket covers in that the cover is designed to prevent any significant movement or deflection of the cover and/or the peripheral edges of the cover with respect to the meter socket which would allow unauthorized access to the interior of the meter socket when the cover is mounted on the meter socket. The ribs having the elongated height fixedly engage the jaw terminals in the meter socket when the cover is mounted in the socket to resist deflection of the peripheral edges of the cover. The ribs also serve to support the blades and prevent sideways movement or flexing of the blades.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
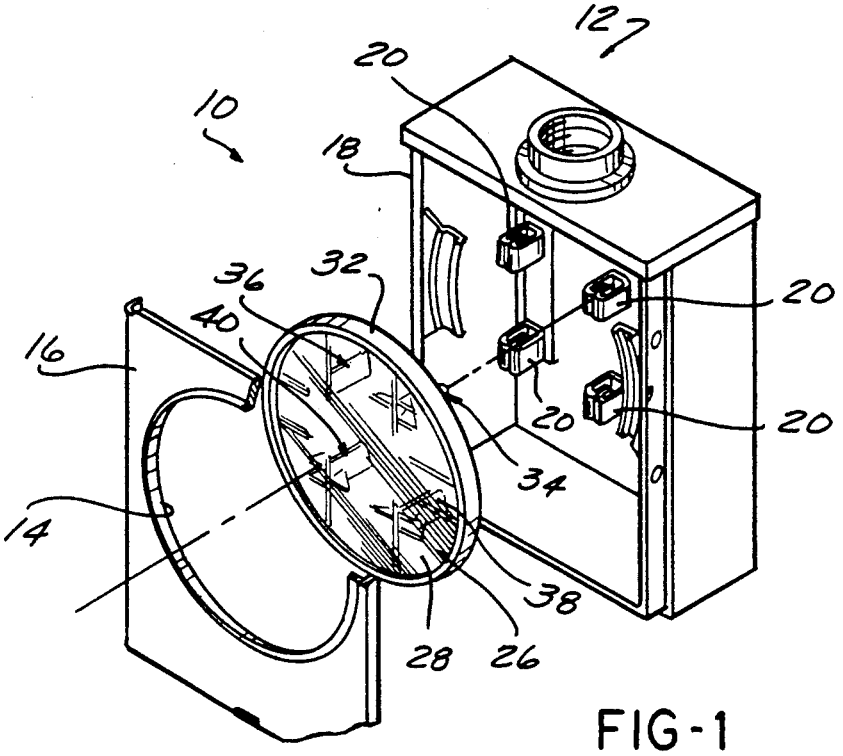
FIG. 1 is an exploded, perspective view showing the bladed meter socket cover of the present invention in an assembled position with respect to a meter socket.

Referring now to the drawing, and to FIG. 1 in particular, there is illustrated a bladed meter socket cover 10 which is employed with a conventional meter socket 12 to close an aperture 14 in a cover plate 16 mounted on the front of the meter socket 12.

As is conventional, the meter socket 12 includes a housing 18 in which are mounted a plurality of spring jaw-type terminals 20. Although four jaw terminals 20 are illustrated in FIG. 1, it will be understood that the meter socket 12 may be provided with more or less terminals 20 depending upon the needs of a particular application. The jaw terminals 20 are designed to normally receive the blade contacts of a watt hour meter, not shown. Further, the jaw terminals 20 are connected to the line and load conductors of an electrical utility and a building or residence to supply electric power to such building or residence.

The cover plate 16 may be of the ring or ringless type. FIG. 1 depicts a ringless-type cover plate 16 in which the watt hour meter, not shown, would normally project through the aperture 14 in the cover plate 16.

Figure 2:
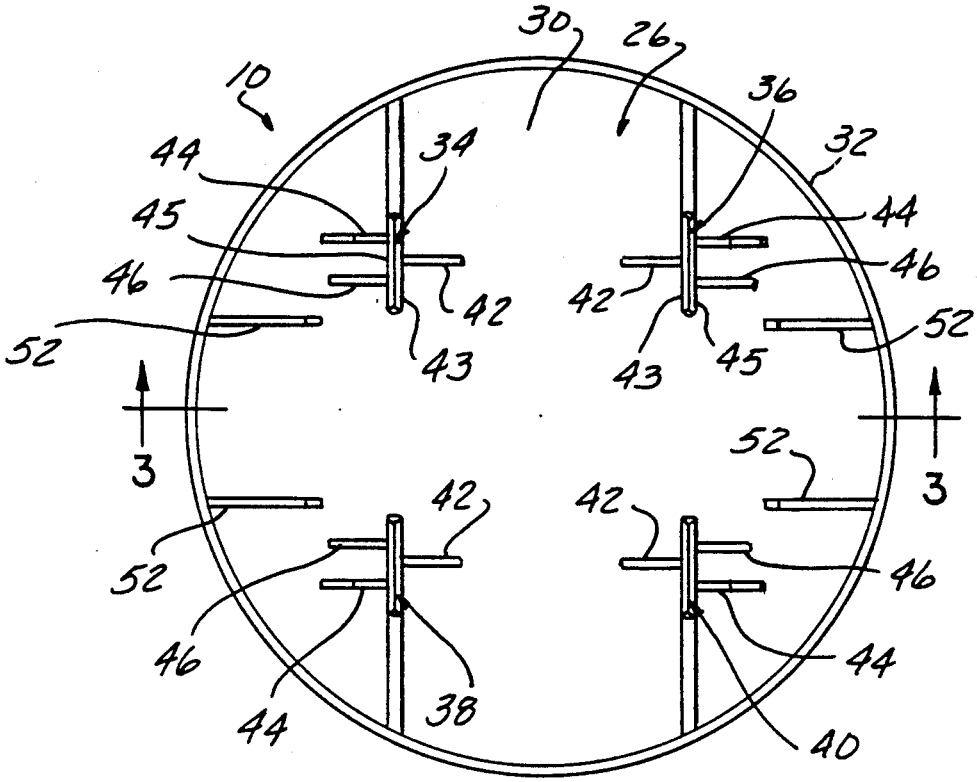
FIG. 2 is a front elevational view of the back major surface of the cover shown in FIG. 1.
Figure 3:
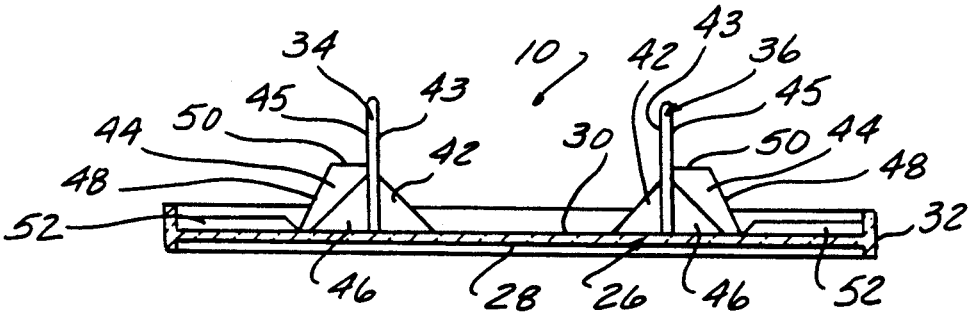
FIG. 3 is a cross sectional view generally taken along line 3—3 in FIG. 2.

The bladed meter socket cover 10 of the present invention, as shown in FIGS. 1, 2 and 3, is designed to close the aperture 14 in the cover plate 16 when a watt hour meter is removed or otherwise not installed in a meter socket 12. The cover 10 includes a planar base 26 preferably having a circular shape. The base 26 is provided with first and second opposed, major surfaces 28 and 30, respectively.

A peripheral rim or flange 32 is integrally formed with and surrounds the peripheral edge of the base 26. The rim 32 has a width so as to extend outwardly from each of the first and second major surfaces 28 and 30, respectively.

A plurality of blades, such as blades 34, 36, 38 and 40, are mounted on and extend outward from one of the first and second major surface 28 and 30, respectively of the base 26. As shown in FIGS. 1, 2 and 3, the blades 34, 36, 38 and 40 extend outward from the second or back major surface 30 of the base 26. Each of the blades 34, 36, 38 and 40 is identically constructed and has a rectangular-shaped cross section adapted to releasably engage the jaw terminals 20 in the meter socket 12. The blades 34, 36, 38 and 40 are oriented perpendicular to the second major surface 30 of the base 26.

Rib means formed of one or more ribs or gussets are associated with each of the blades 34, 36, 38 and 40. The rib means support each of the blades and prevent the blades from flexing or moving sideways with respect to the base 26 of the cover 10.

Figure 4:
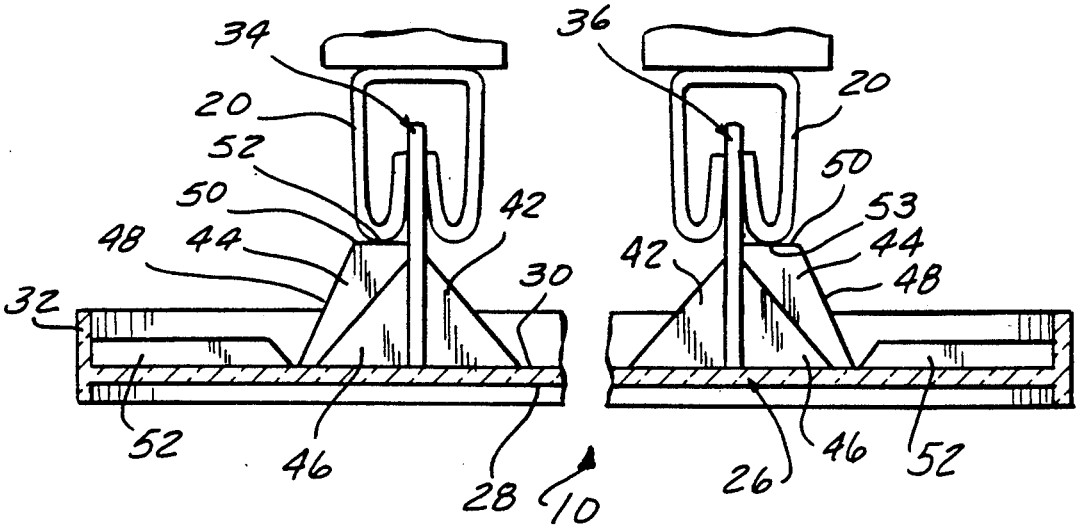
FIG. 4 is a cross sectional view generally taken along line 3—3 in FIG. 2; but showing the cover of the present invention mounted in the jaw terminals in a meter socket.

FIG. 2 depicts one embodiment of the rib means in which the rib means comprises first, second and third ribs 42, 44 and 46, respectively, for each of the blades 34, 36, 38 and 40. Since each of the rib means in this embodiment is identically constructed, only the rib means for blade 34 will be described in detail. The first rib 42 for the blade 34 is mounted on one side 43 of the blade 34 and extends between and is joined to the second major surface 30 of the base 26 and the one side 43 of blade 34. As shown in FIGS. 3 and 4, the first rib 42 has a generally triangular configuration.

The second and third ribs 44 and 46 are disposed on the opposite side 45 of the blade 34 from the first rib 42 and are spaced apart as shown in FIG. 2. The third rib 46 is identically constructed as the first rib 42 and has a generally triangular configuration. Both of the first and third ribs 42 and 46, respectively, have a height from the surface 30 of the base 26 so as to be spaced from the outer edges of the jaw terminals 20 in the meter socket 12 when the cover 10 is mounted in the meter socket 12 with the blades 34, 36, etc., engaging the jaw terminals 20, as shown in FIG. 4.

The second rib 44 has an extended height from the surface 30 of the base 26 as shown in FIGS. 3 and 4. The second rib 44 has an angular side edge 48 and a straight upper edge 50 preferably extending perpendicular from the blade 34. The upper edge 50 is spaced from and preferably parallel to the second major surface 30 of the base 26. The second rib 44 is mounted on and extends between the second major surface 30 of the base 26 and the blade 34 as shown in FIG. 3. The height of the second rib 44 is selected such that the upper edge 50 of the second rib 44 engages the exterior end 53 of the jaw terminal 20 when the cover 10 is mounted in the meter socket 12 as shown in FIG. 4. The fixed connection between the second rib 44 and the jaw terminal 20, as shown in FIG. 4, prevents inward movement or flexing of the cover 10 with respect to the meter socket 12 which would undesirably enable the peripheral edge or rim 32 of the cover 10 to be urged inward from the cover plate 16 and allow access to the interior of the meter socket 20.

It should be noted that the second rib 44 is disposed radially outermost from the center of the cover 10 of all of the ribs for each blade. This increases the deflection resistance of the cover 10.

While the second rib 44 has been described and illustrated as being associated with each of the four blades 34, 36, 38 and 40, which may be employed in greater or less numbers depending upon the particular configuration of the meter socket 12 with which the cover 10 is to be used, it should be noted that the enlarged height second rib 44 need be provided with only one of the blades, such as blade 34. A more secure arrangement can be had by providing one diagonally opposed pair of blades 34 and 40, for example, with the second rib 44. However, the maximum resistance to deflection or inward movement of the cover 10 is obtained by providing the second rib 44 with the enlarged height on all of the blades on the cover 10.

Figure 5:
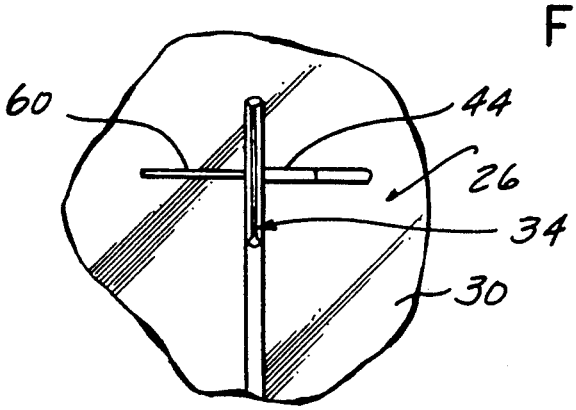
FIG. 5 is a partial, enlarged view showing an alternate embodiment of the rib means employed on a bladed meter socket cover of the present invention.

FIG. 5 depicts an alternate arrangement of the rib means employed on the cover 10. In this embodiment, one rib 60 having a generally triangular shape, similar to the first and third ribs 42 and 46, is mounted on one side of a blade, such as blade 34. The second rib 44 having the enlarged height is mounted on the opposite side of the blade 34 and is co-planar arranged with the rib 50.

As is conventional, additional ribs or gussets 52 may be mounted or formed on either of the opposed surfaces 28 and 30 of the base 26 to provide rigidity to the cover 10.

The blades 34, 36, 38 and 40, the ribs associated with the blades, and the additional ribs 52 are preferably integrally formed as a single piece unit from a molded plastic. Plastic is chosen for its non-conductive characteristics. By way of example only, a polycarbonate, such as that sold under the trademark LEXAN by General Electric, may be employed to form the cover 10 of the present invention. Alternately, the blades and ribs may be applied to the base 26 as separate elements.

In summary, there has been disclosed a bladed meter socket cover which is designed to resist deformation or inward movement when the cover is mounted in a meter socket. The provision of a rib associated with at least one and preferably all of the blades on the cover which has an enlarged height so as to fixedly engage the jaw terminals in the meter socket when the cover is mounted in the meter socket prevents inward movement of the cover, particularly deflection of the peripheral edge of the cover, which would allow unauthorized access to the interior of the meter socket.

What is claimed is:

1. A cover for a meter socket having a plurality of jaw terminals and a cover plate having an aperture formed therein for normally receiving a watt hour meter therethrough, the cover comprising:

a planar base having first and second opposed major surfaces;

a plurality of blades mounted on and extending outward from the second major surface of the base for releasably engaging the jaw terminals of the meter socket to mount the cover in the meter socket; and rib means, mounted on and extending between the base and at least one of the blades, for supporting the one blade and preventing movement of the one blade relative to the base, the rib means having a predetermined height such that an exterior edge of the rib means contacts one of the jaw terminals of the meter socket when the cover is mounted in the meter socket.

2. The cover of claim 1 wherein:

the rib means includes a planar upper edge spaced from the base, the upper edge engageable with the jaw terminal when the cover is mounted in the meter socket.

3. The cover of claim wherein the rib means comprises:

a first rib mounted on and extending between the base and one side of at least blade the first rib having height so as to be spaced from a jaw terminal when the cover is mounted in the meter socket; and a second rib mounted on and extending between the base and an opposed side of the at least one blade, the second rib having a height to contact the jaw terminal when the cover is mounted in the meter socket.

4. The cover of claim 3 wherein:

the first and second ribs are co-planar.

5. The cover of claim 3 wherein:

the first rib is associated with each of the plurality of blades; and the second rib is associated with each one of a pair of diagonally opposed blades.

6. The cover of claim 3 wherein:

the first and second ribs are associated with each of the plurality of blades on the cover.

7. The cover of claim 6 further including:

a plurality of third ribs, each mounted on and extending between the base and the opposed side of one of all of the blades, each of the third ribs being spaced from the associated second rib.

8. The cover of claim 3 wherein the rib means further includes:

a third rib mounted on and extending between the base and the opposed side of the at least one blade, the third rib being spaced from the second rib.

9. The cover of claim 8 wherein:

the second rib is disposed radially outermost from the center of the base with respect to the third rib.

10. A cover for a meter socket having a plurality of jaw terminals and a cover plate having an aperture formed therein for normally receiving a watt hour meter therethrough, the cover comprising:

a planar base having first and second opposed major surfaces;

a plurality of blades mounted on and extending outward from the second major surface of the base for releasably engaging the jaw terminals of the meter socket to mount the cover in the meter socket;

a first rib mounted on and extending between the base and one side of each blade, the first rib having a height so as to be spaced from a jaw terminal when the cover is mounted in the meter socket;

a second rib mounted on and extending between the base and an opposed side of each blade, the second rib having a height to contact the jaw terminal when the cover is mounted in the meter socket, the second rib having a planar upper edge engageable with the jaw terminal to prevent deflection of the cover with respect to the cover plate when the cover is mounted in the meter socket; and a third rib mounted on and extending between the base and the opposed side of each blade, the third rib being spaced from the second rib, the second rib being disposed radially outermost from the center of the base with respect to the third rib.

11. An electric meter assembly comprising:

a meter socket housing;

a plurality of jaw terminals mounted in the meter socket housing;

a cover plate mountable over the meter socket housing, the cover plate having an aperture for normally receiving a watt hour meter therethrough;

a cover including:

a planar base having first and second opposed major surfaces;

a plurality of blades mounted on and extending outward from the second major surface of the base for releasably engaging the jaw terminals of the meter socket to mount the cover in the meter socket; and rib means, mounted on and extending between the base and at least one of the blades, for supporting the one blade and preventing movement of the one blade relative to the base, the rib means having a predetermined height such that an exterior edge of the rib means contacts one of the jaw terminals of the meter socket when the cover is mounted in the meter socket.

12. The electric meter assembly of claim 11 wherein the rib means comprises:

a first rib mounted on and extending between the base and one side of at least one blade, the first rib having a height so as to be spaced from a jaw terminal when the cover is mounted in the meter socket; and a second rib mounted on and extending between the base and an opposed side of the at least one blade, the second rib having a height to contact the jaw terminal when the cover is mounted in the meter socket.

13. The electric meter assembly of claim 11 wherein:

the first and second ribs are co-planar.

14. The electric meter assembly of claim 11 wherein:

the rib means includes a planar upper edge spaced from the base, the upper edge engageable with the jaw terminal when the cover is mounted in the meter socket.

15. The electric meter assembly of claim 11 wherein:

the first and second ribs are associated with each of the plurality of blades on the cover.

16. The electric meter assembly of claim 15 further including a plurality of third ribs, each mounted on and extending between the base and the opposed side of one of all of the blades, each of the third ribs being spaced from the associated second rib.

17. The electric meter assembly of claim 11 wherein:

the first rib is associated with each of the plurality of blades; and the second rib is associated with each one of a pair of diagonally opposed blades.

18. The electric meter assembly of claim 17 wherein the rib means further includes:

a third rib mounted on and extending between the base and the opposed side of the at least one blade, the third rib being spaced from the second rib.

19. The electric meter assembly of claim 18 wherein:

the second rib is disposed radially outermost from the center of the base with respect to the third rib.

20. An electric meter assembly comprising:

a meter socket housing;

a plurality of jaw terminals mounted in the meter socket housing;

a cover plate mountable over the meter socket housing, the cover plate having an aperture for normally receiving a watt hour meter therethrough;

a cover including:

a planar base having first and second opposed major surfaces;

a plurality of blades mounted on and extending outward from the second major surface of the base for releasably engaging the jaw terminals of the meter socket to mount the cover in the meter socket;

a first rib mounted on and extending between the base and one side of each blade, the first rib having a height so as to be spaced from a jaw terminal when the cover is mounted in the meter socket;

a second rib mounted on and extending between the base and an opposed side of each blade, the second rib having a height to contact the jaw terminal when the cover is mounted in the meter socket, the second rib having a planar upper edge engageable with the jaw terminal to prevent deflection of the cover with respect to the cover plate when the cover is mounted in the meter socket; and a third rib mounted on and extending between the base and the opposed side of each blade, the third rib being spaced from the second rib, the second rib being disposed radially outermost from the center of the base with respect to the third rib.

* * * * *